US008058947B2

(12) United States Patent
Moll

(10) Patent No.: US 8,058,947 B2
(45) Date of Patent: Nov. 15, 2011

(54) HIGH-PERFORMANCE COUPLER

(75) Inventor: Ludwig Moll, Raisting (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 253 days.

(21) Appl. No.: 12/527,797

(22) PCT Filed: Jan. 22, 2008

(86) PCT No.: PCT/EP2008/000465

§ 371 (c)(1),
(2), (4) Date: Aug. 19, 2009

(87) PCT Pub. No.: WO2008/101578

PCT Pub. Date: Aug. 28, 2008

(65) Prior Publication Data

US 2010/0109797 A1 May 6, 2010

(30) Foreign Application Priority Data

Feb. 22, 2007 (DE) ..... 10 2007 008 753

(51) Int. Cl.
*H01P 5/18* (2006.01)
*H01P 3/08* (2006.01)

(52) U.S. Cl. ..... 333/116; 333/246

(58) Field of Classification Search ..... 333/109, 333/110, 111, 112, 115, 116, 246
See application file for complete search history.

(56) References Cited

U.S. PATENT DOCUMENTS

| | | | | |
|---|---|---|---|---|
| 3,496,492 | A | 2/1970 | Kurzl et al. | |
| 3,974,462 | A * | 8/1976 | Fassett | 333/22 R |
| 7,151,422 | B2 * | 12/2006 | Pivit et al. | 333/117 |
| 2001/0026199 | A1 | 10/2001 | Nishimura et al. | |
| 2003/0020649 | A1 | 1/2003 | Solbach | |
| 2006/0208827 | A1 | 9/2006 | Pivit et al. | |

FOREIGN PATENT DOCUMENTS

| | | | |
|---|---|---|---|
| DE | 1291807 | | 4/1969 |
| DE | 19605569 | A1 | 8/1997 |
| DE | 19837025 | A1 | 2/2000 |
| EP | 468658 | A2 | 1/1992 |
| JP | 60242703 | A | 12/1985 |
| JP | 6464407 | A | 3/1998 |
| WO | 03055065 | A1 | 7/2003 |

OTHER PUBLICATIONS

International Search Report, WO 2008/101578 A1, Apr. 29, 2008, pp. 26-31.

Gipprich J. et al, "A compact 8-14 Ghz LTCC stripline coupler network for high efficiency power combining with better than 82% combining efficiency," Microwave Symposium Digest, 1995.

International Preliminary Examination Report, PCT/EP2008/000465, Sep. 4, 2009, pp. 1-5.

* cited by examiner

*Primary Examiner* — Dean Takaoka
(74) *Attorney, Agent, or Firm* — Ditthavong Mori & Steiner, P.C.

(57) ABSTRACT

A high-load coupler with a first input port, which is connected via a first stripline to an output port, and with at least one second input port, which is connected to an absorber, which provides at least one second stripline, a coupling portion and a connection portion. The at least one second input port is connected via at least one second stripline directly to the absorber. The at least one second stripline is designed as a middle conductor of a triplate line and the absorber is disposed on a thermally-conductive surface of a cooling-medium pipe. The cooling-medium pipe is connected to one housing half.

20 Claims, 4 Drawing Sheets

HIGH-PERFORMANCE COUPLER

CROSS-REFERENCE TO RELATED APPLICATION

The present application is a national phase application of PCT Application No. PCT/EP2008/000465, filed on Jan. 22, 2008, and claims priority to German Application No. 10 2007 008 753.7, filed on Feb. 22, 2007, the entire contents of which are herein incorporated by reference.

BACKGROUND OF THE INVENTION

1. Field of the Invention

The invention relates to a high-load coupler.

2. Discussion of the Background

A directional coupler, in which two striplines are disposed side-by-side on a substrate, is known from DE 198 37 025 A1. The known directional coupler has the disadvantage that an integrated arrangement of an absorber is not provided. A further absorber connection, on which an external absorber can be arranged, must therefore be provided on the known directional coupler. Such external absorbers generally consist of one or more resistor elements, which, for their part, are disposed on a substrate. Accordingly, the known coupler has the disadvantage that two initially-independent component groups must be connected to one another. As a result, a considerable structural cost and manufacturing cost is required and, a costly housing to be fitted from both sides must be provided for the combined assembly of the two printed circuit boards.

SUMMARY OF THE INVENTION

Embodiments of the invention advantageously provide a high-load coupler simplified especially with regard to its manufacture.

The high-load coupler according to the invention provides a first input port and at least one second input port. The first input port is connected via a stripline to an output port. The second input port is connected via a second stripline to an absorber. The at least one second stripline provides a coupling portion and a connection portion, which is connected directly to the absorber. Furthermore, the at least one stripline is designed as a middle conductor of a triplate line.

The high-load coupler according to the invention has the advantage that both the coupling of the second input port and also the connection to an absorber are realized through the second stripline. This second stripline is, at the same time, the middle conductor of a triplate line. The separate manufacture of two printed circuit boards, on which striplines are disposed in each case, and especially the contacting of the two printed circuit boards, are therefore not required. Moreover, the middle conductor of the triplate line is disposed substantially in one plane.

A simple structure of the high-load coupler as a whole is therefore achieved.

In particular, it is advantageous to design the first and/or the at least one second stripline as a punched component or as a punched and folded component. In this context, the connection portion of the second stripline is preferably used for impedance transformations. The separate manufacture of an impedance converter is not therefore required, wherein, in particular, the assembly of the individual components of the high-load coupler is also facilitated.

Furthermore, it is advantageous to construct the absorber from at least two absorber elements. Accordingly, a single absorber element must be designed only for a relatively lower power. In this context, the individual absorber elements of an absorber are preferably designed as flange resistors.

The first and the at least one second striplines are preferably disposed between two housing halves of the high-load coupler, wherein the two housing halves each form earth conductors. Together with the stripline, the two housing halves therefore form the triplate line. For the adjustment of the corresponding surge impedance or respectively the impedance of this triplate line, the striplines are disposed in a hollow cavity formed by two housing halves.

In order to remove the heat occurring in the absorber in the event of a failure of an input signal, the absorber is preferably disposed on a thermally-conductive surface of a cooling-medium pipe. The cooling-medium pipe is connected to one housing half. Through the arrangement of the absorber on a cooling-medium pipe of this kind, the quantity of heat occurring can be removed in a simple manner by a cooling medium. Especially if a cooling-medium circuit is already provided for cooling the connected amplifier, a shared cooling-medium circuit can be realized in a particularly simple manner.

In order to position the first stripline and the second stripline in the correct position relative to one another, non-conductive fixing elements, which connect the first stripline to the second stripline are preferably provided. The fixing elements are provided in the region of the coupling portion of the first stripline and of the second stripline.

BRIEF DESCRIPTION OF THE DRAWINGS

A preferred exemplary embodiment of the high-load coupler according to the invention is presented in the drawings and described in greater detail in the description below. The drawings are as follows.

DETAILED DESCRIPTION OF EXEMPLARY EMBODIMENTS OF THE INVENTION

Figure 1:
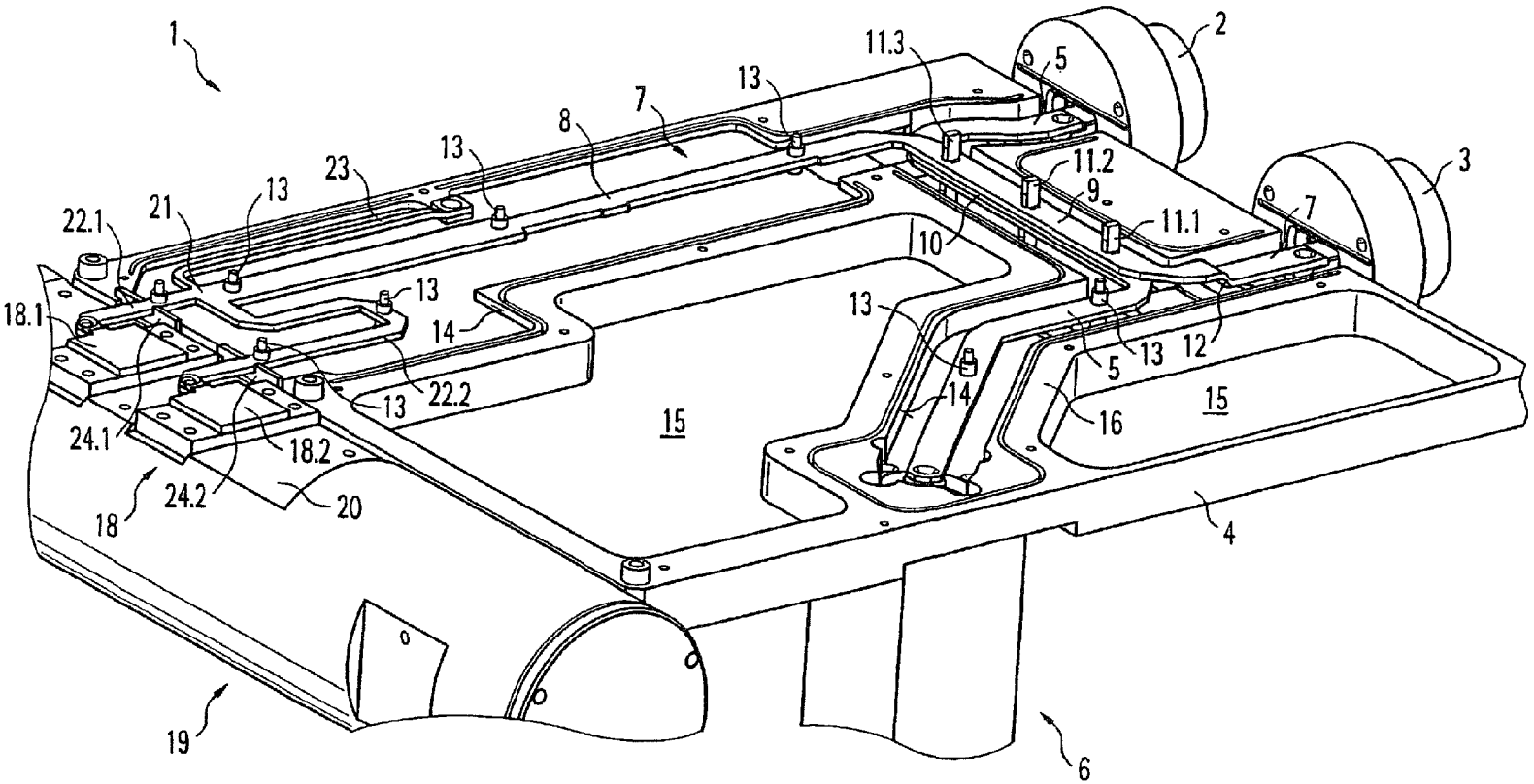
FIG. 1 shows a perspective view of a high-load coupler with two input ports.

FIG. 1 presents a high-load coupler 1 according to the invention with two input ports 2, 3. The high-load coupler 1 provides a first input port 2 for the connection, for example, of a first power amplifier, and a second input port 3 for the connection of a second power amplifier. The first input port 2 and the second input port 3 are mounted on the end-face of a first housing half 4 of the high-load coupler 1. A first stripline 5 or respectively a second stripline 7 is connected to the respective middle contact of the input ports 2, 3.

The first stripline 5 connects the middle contact of the first input port 2 directly to an output port 6. The output port 6 is provided, for example, to connect the high-load coupler 1 to a transmission antenna. The second stripline 7 provides a coupling portion 9 and a connection portion 7 connected to the latter. In this context, the coupling portion 9 is disposed at the side of the second stripline facing towards the second input port 3. The coupling portion 9 of the second stripline 7 is disposed parallel to a coupling portion 10 of the first stripline 5. In the region of the coupling portions 9, 10, the two striplines 5, 7 extend parallel to one another. The two striplines 5, 7 are disposed at a slight spacing distance from one another within the region of the coupling portion 9, 10.

In order to keep the spacing distance constant in the region of the coupling portions 9, 10, fixing elements 11.1 to 11.3 are provided. The fixing elements 11.1 to 11.3 engage through the coupling portions 9, 10 of the first stripline 5 and of the second stripline 7. The fixing elements 11.1 to 11.3 are made, for example, of PTFE.

The first input port 2 and the second input port 3 are disposed on one level with reference to the first housing half 4. In order to allow a spaced arrangement of the coupling portions 9, 10 in the region of the coupling portion 9 or respectively 10, a step 12 is provided in the second stripline 7 on a portion arranged between the coupling portion 9 and the second input port 3.

In each case, the striplines 5 and 7 form a middle conductor of a triplate line. The earth lines disposed at both sides of the two striplines 5, 7 are each formed by a housing half 4 and a second housing half not illustrated in FIG. 1. In the first housing half 4, recesses 14 are provided for this purpose. The recesses 14 accommodate the first stripline 5 and respectively the second stripline 7. Furthermore, indentations 15 are provided in the first housing half 4. The indentations 15 are provided for weight-saving and are preferably disposed so deeply in the first housing half 4, that only a thin covering surface remains on an external side as a continuous surface of the first housing half 4.

Around the recesses 14 for the accommodation of the striplines 5, 7, an attachment surface 16 is provided between the recesses 14 and the adjacent indentations 15 and towards the exterior edge of the housing half 4. A groove 17 is disposed in the attachment surface 16 along the recesses 14. The groove 17 is provided for the accommodation of a sealing thread. The sealing thread is designed as a high-frequency sealing thread.

A cooling-medium pipe 19 is arranged at an end disposed opposite to the first input port 2 and the second input port 3 of the first housing half 4. The cooling-medium pipe 19 is flattened in a region, which corresponds with the connection portion 8, and forms a thermally-conductive surface 20 in this region. An absorber 18 is disposed on the thermally-conductive surface 20. The absorber 18 is preferably designed as a flange resistor and, in the exemplary embodiment presented, consists of a first absorber element 18.1 and a second absorber element 18.2.

The connection portion 8 of the first stripline 5 branches at a remote end 21 into a first branch conductor 22.1 and a second branch conductor 22.2. The first branch conductor 22.1 connects the first absorber element 18.1 to the connection portion 8. Correspondingly, the second branch conductor 22.2 also connects the second absorber element 18.2 to the connection portion 8. Moreover, an earth conductor 23 branches off from the remote end 21 of the connection portion 8. The earth conductor 23 is connected to the first housing half 4, for example, by means of a screw.

For the respective contacting of the absorber element 18.1 and 18.2, one end of the branch conductors 22.1 and respectively 22.2 projects at the end of the first housing half 4 facing away from the input ports 2 and 3 beyond this first housing half 4. Spacers 13 are provided for fixing the position of the first stripline 5 and the second stripline 7. The spacers 13 penetrate the first stripline 5 and respectively the second stripline 7 through boreholes provided for this purpose in the striplines 5, 7. Moreover, the spacers 13 provide cross-sectional variations, which ensure a central position of the stripline 5 and of the stripline 7 between the two housing halves.

The function of the high-load coupler 1 with two input ports 2 and 3 presented is explained briefly below. An input signal, which is generated by a first power amplifier, is connected at the first input port 2. A second input signal, which is, however, phase-displaced relative to the first input signal, is provided at the second input port 3. In this context, the second input signal is phase-displaced by 90° relative to the first input signal. Provided both power amplifiers at the two input ports 2 and 3 are in operation, there is an amplifying coupling in the region of the coupling portions 9, 10, and the total power of the two power amplifiers is supplied via the output port 6, for example, to a transmission antenna. As a result of the phase position of the two input signals, a deletion of the signals occurs at the end of the coupling path disposed towards the connection portion 8. With an ideal deletion, the power absorbed by the absorber 18 is therefore 0.

By contrast, if one of the two power amplifiers fails, then one of the two phase-displaced signals will be missing. The absence of superposition means that a part of the power of the input signal is routed further in the connection portion 8. This further-routed part of the power is absorbed in the absorber 18. The heat occurring in this context is supplied via the thermally-conductive surface 20 of the cooling-medium pipe 19 and accordingly to the cooling medium disposed therein. The cooling-medium pipe 19 is preferably a component of the cooling-medium circuit, which is also provided for cooling the connected power amplifier.

In FIG. 1, the high-load coupler 1 with two input ports 2 and 3 is shown open. The second, upper housing half, not illustrated in FIG. 1, is structured substantially in mirror image to the illustrated lower housing half 4. In particular, the recesses 14 of the lower housing half 4 and recesses in the upper housing half correspond to one another.

As already explained, an end of the first branch conductor 22.1 and the second branch conductor 22.2 passes outwards from the region of the first housing half 4 for contacting. Insulating elements 24.1 and 24.2 are provided in the region of the passages. The insulating elements 24.1 and respectively 24.2 each provide a recess, through which the branch conductors 22.1 and respectively 22.2 pass laterally. The position of the branch conductors 22.1 and respectively 22.2 is additionally fixed by the insulating elements 24.1 and 24.2 in addition to the spacers 13. A cover, which is not illustrated in FIG. 1, is provided to cover the absorber elements 18.1 and 18.2 and the branch conductors 22.1 and 22.2 projecting from the housing of the high-load coupler 1. The cover is preferably screwed onto the thermally-conductive surface 20.

Figure 2:
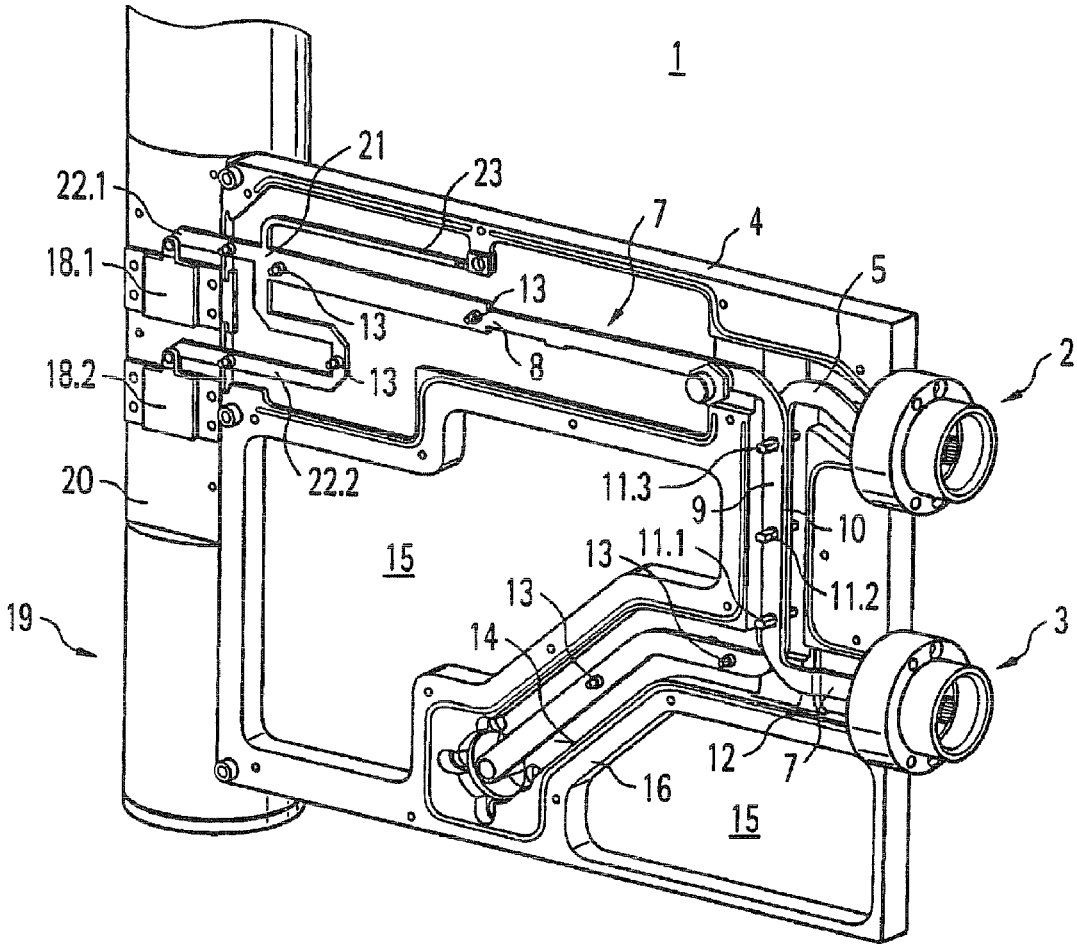
FIG. 2 shows a second perspective view of a high-load coupler according to FIG. 1.

A second perspective view of the high-load coupler 1 according to the invention from FIG. 1 is presented in FIG. 2. The parallel passage of the two striplines 5 and 7 in the region of the coupling path is once again evident in this context. The length of the coupling path is preferably $\lambda/4$, from which the phase displacement of the input signals by 90° mentioned above is derived.

In FIG. 2, it is also clearly evident that the connection portion 8 of the second stripline 7 forms a line transformer. For this purpose, the connection portion 8 is designed as a so-called "tapered line". The transformation is used for impedance matching. The two absorber elements 18.1 and 18.2 can, for example, provide an impedance of 25 ohms. Through the line transformation of the connection portion 8, these 25 ohms of the two absorber elements 18.1, 18.2 are matched to the connection impedance 50 ohms of the input ports 2 or respectively 3. If larger adaptations are required, a multi-step modification of the width of the striplines 7 in the region of the connection portion 8 may be necessary. In FIG. 2, a matching of the impedance through two steps is illustrated.

Figure 3:
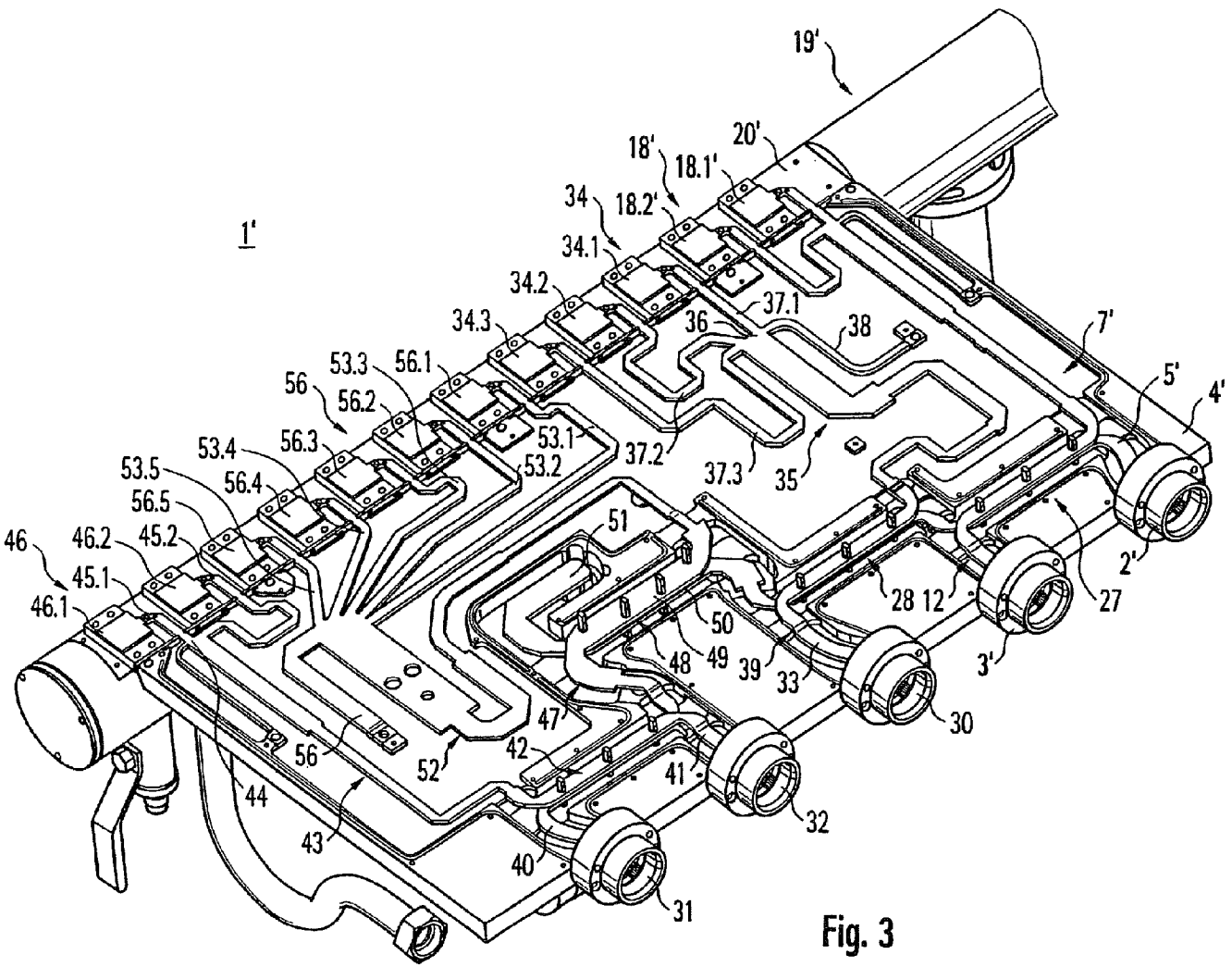
FIG. 3 shows a first perspective view of a high-load coupler with five input ports.

FIG. 3 shows a second example of a high-load coupler 1' according to the invention in a first perspective. Three further input ports 30, 31 and 32 are provided in addition to the first input port 2' and the second input port 3'. The further input ports 30, 31 and 32 are provided at the same end face of the lower housing half 4', on which the first input port 2' and the second input port 3' are also disposed. By contrast with the exemplary embodiment of FIG. 1, at its end facing away from the first input port 2', the first stripline 5' does not pass directly to the output port 6'. On the contrary, a second coupling path 28 follows the first coupling path 27 with the second stripline 7'.

In the region of the second coupling path 28, the summed signal of the two input signals of the first input port 2' and of the second input port 3' is coupled with the further input signal of the third input port 30.

In the region of the second coupling path 28, the first stripline 5' therefore runs parallel to a third stripline 33. The third stripline 33 passes from a middle contact of the third input port 30 to a second absorber 34. Because of the relatively-higher power to be absorbed in the case of a failure of one power amplifier, a total of three absorber elements 34.1 to 34.3 are provided here. The three absorber elements 34.1 to 34.3 together form the second absorber 34. In the exemplary embodiment presented with five input ports, the thermally-conductive surface 20 extends over the entire length of the lower housing half 4'. As already explained for the second stripline 2 in the case of the simple exemplary embodiment of the high-load coupler 1 with only two input ports 2' and 3', a connection portion 35 is also provided for the third stripline 33.

The connection portion 35 of the third stripline 33, which is also formed as a line transformer, branches at its end 36 facing away from the second coupling path 28 into three further striplines 37.1 to 37.3 and into a further earth conductor 38. The three further striplines 37.1 to 37.3 each connect an absorber element 34.1 to 34.3 of the second absorber to the connection portion 35 at the remote end 36 of the third stripline 33. The further earth conductor 38 is connected by a screw connection to the lower housing half 4' in the manner already described.

As already described for the exemplary embodiment of FIG. 1, the first stripline 5', the second stripline 7' and also the third stripline 3' are designed as punched parts or punched and folded parts and, in particular, preferably in one-piece. In this context, it is particularly preferred if the first stripline 5' is designed as a pure punched part. The first stripline 5' then extends in one plane. Any height offset required in the case of the second stripline 7' is achieved by the step 12 already described. In a corresponding manner, such a step 39 is also provided in the third stripline 33 between the third input port 30 and the second coupling path 28. Beyond the second coupling path 28, a further step can be provided in the third stripline 33, in order to achieve the central position between the housing halves.

The first stripline 5' and the third stripline 33 are also connected to one another in the region of the second coupling path 28 via further fixing elements 11.4 to 11.7.

For the further coupling of the power of a fourth and fifth power amplifier, which are connected to the fourth input port 31 and respectively the fifth input port 32, the input signals of the fourth and of the fifth input port 31 and respectively 32 are initially coupled to one another. For this purpose, the fourth input port 31 is connected to a fourth stripline 40. The fifth input port 32, by contrast, is connected to a fifth stripline 41. As in the case of the simple high-load coupler with only two input ports, each of the striplines 40, 41 initially extends in the region of a third coupling portion 42 parallel to one another. The fifth stripline 41 provides a connection portion 43, of which the end 44 facing away from the third coupling path 42 branches into a first branch conductor 45.1 and a second branch conductor 45.2 of the fifth stripline 41. Via the connection portion 43 and the branch conductors 45.1 and 45.2, the fifth input port 32 is connected to a sixth absorber element 46.1 and a seventh absorber element 46.2. The two absorber elements 46.1 and 46.2 together form a third absorber 46. The third absorber 46 is also disposed on the thermally-conductive surface 20.

Like the second stripline 7', the third stripline 33 and the fifth stripline 41, the fourth stripline 40 merges on the side of the third coupling path 42 facing away from the fourth input port 31 into a connection portion 47. By way of distinction from the other striplines, however, the connection portion 47 of the fourth stripline 40 provides an additional coupling portion 49 alongside the line transformer. The additional coupling portion 49 is disposed parallel to a third coupling portion 50 of the first stripline 5'.

The additional coupling portion 49 and the third coupling portion 50 of the first stripline 5' are, once again, disposed parallel to one another and are fixed with regard to their spacing distance and their position by four further fixing elements 11.8 to 11.11.

After the power of the power amplifier, which is connected to the second input port 3', has been summed in the first stripline 5' at its first coupling portion 10 to the input signal of the first input port 2', and the power of the power amplifier, which is connected to the third input port 30, has been supplemented in the further course of the first stripline 5' in the region of the second coupling path 28, the sum of the powers of the two power amplifiers, which are connected to the fourth input port 31 and to the fifth input port 32, is now coupled in the region of the fourth coupling path 48.

An end of the first stripline 5' facing away from the first input port 2' connects the first stripline 5' to the output port 6', which is not visible in FIG. 3.

At the end of the additional coupling portion 49 facing away from the fourth input port 31, a transformer portion 52 is connected. The transformer portion 52 branches at its end facing away from the additional coupling portion 49 into five further branch conductors 53.1 to 53.5 of the fifth stripline 41 and a fourth earth conductor 56. Like all other branch conductors of the second to fourth striplines 5', 7' and 40, the five further branch conductors 53.1 to 53.5 are guided out from the housing of the high-load coupler at the end disposed opposite to the input ports. Each of the further branch conductors 53.1 to 53.5 is also connected there respectively to an absorber element 56.1 to 56.5. The five absorber elements 56.1 to 56.5 together form a fourth absorber 56.

The number of absorber elements forming an absorber in each case is determined according to the power, which is to be absorbed in the event of an amplifier failure. In the event of a failure of the power amplifier connected to the fourth input port 31, since a correspondingly high total power must be absorbed, because of the already implemented coupling of the powers of the other four amplifiers, the fifth absorber 56 in the exemplary embodiment presented must therefore already comprise five absorber elements 56.1 to 56.5. In this context, it is assumed that all absorber elements used are structured in an identical manner and provide an identical loading capacity.

Figure 4:
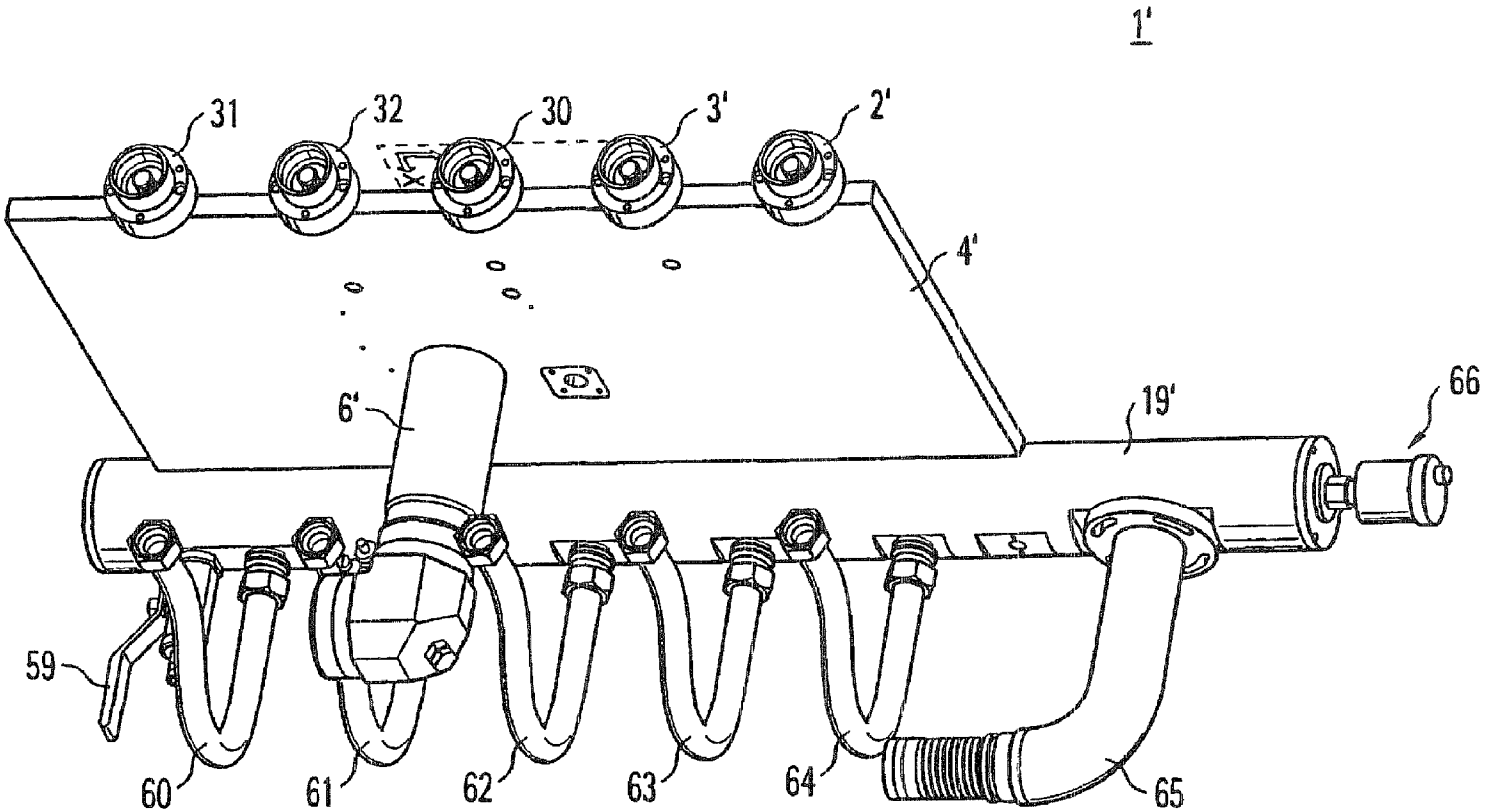
FIG. 4 shows a perspective view of the rear side of the high-load coupler of FIG. 3 with one output port.

In FIG. 4, a second perspective of the high-load coupler of FIG. 3 is presented. It is evident that the output port 6' is provided on the first housing half 4'. The output connection 6' is provided, for example, for the connection of the high-load coupler 1' to a transmission antenna.

A fluid-draining tap 59 is disposed in the cooling-medium pipe 19'. In the exemplary embodiment presented, the cooling-medium pipe 19' is designed as a collecting pipe. The collecting pipe is connected via five connector pipes 60 to 64, for example, to the cooling circuits of the connected power amplifiers. The cooling medium returning from the power amplifiers is supplied via the connector pipes 60 to 64 to the cooling-medium pipe 19' and removed in combination via a feedback pipe 65. The feedback pipe 65 guides the heated cooling medium back to a cooler.

At one end-face of the cooling-medium pipe 19, an air-release device 66 is provided. The cooling-medium circuit can be automatically degassed by means of the air-release device 66.

The invention is not restricted to the exemplary embodiment presented. In particular, other numbers of input or output ports are conceivable, and individual features of the example illustrated can be combined with one another.

The invention claimed is:

1. A high-load coupler with a first input port, which is connected via a first stripline to an output port, and with at least one second input port, which is connected to an absorber, which provides at least one second stripline, a coupling portion and a connection portion, wherein:

the at least one second input port is connected via at least one second stripline directly to the absorber;

the at least one second stripline is configured as a middle conductor of a triplate line; and the absorber is disposed on a thermally-conductive surface of a cooling-medium pipe, wherein the cooling-medium pipe is connected to one housing half.

2. The high-load coupler according to claim 1, wherein the first stripline and/or the at least one second stripline is manufactured as a punched part or a punched and folded part.

3. The high-load coupler according to claim 1, wherein the absorber comprises one or more absorber elements.

4. The high-load coupler according to claim 3, wherein an end of the connection portion facing away from the coupling portion is connected respectively by a branch conductor in each case to an absorber element.

5. The high-load coupler according to claim 1, wherein the absorber provides one or more resistors.

6. The high-load coupler according to claims 1, wherein the connection portion is formed as a line transformer.

7. The high-load coupler according to claim 1, wherein the striplines are disposed in a hollow cavity formed from two housing halves and the housing halves in each case form an earth conductor.

8. The high-load coupler according to claim 1, wherein, the first stripline is connected to the second stripline by non-conductive fixing elements, and the fixing elements determine the position of the two striplines relative to one another in the region of the coupling portions.

9. The high-load coupler according to claim 2, wherein the absorber comprises one or more absorber elements.

10. The high-load coupler according to claim 9, wherein an end of the connection portion facing away from the coupling portion is connected respectively by a branch conductor in each case to an absorber element.

11. The high-load coupler according to claim 2, wherein the absorber provides one or more resistors.

12. The high-load coupler according to claim 3, wherein the absorber provides one or more resistors.

13. The high-load coupler according to claim 4, wherein the absorber provides one or more resistors.

14. The high-load coupler according to claim 2, wherein the connection portion is formed as a line transformer.

15. The high-load coupler according to claim 3, wherein the connection portion is formed as a line transformer.

16. The high-load coupler according to claim 4, wherein the connection portion is formed as a line transformer.

17. The high-load coupler according to claim 2, wherein the striplines are disposed in a hollow cavity formed from two housing halves, and the housing halves in each case form an earth conductor.

18. The high-load coupler according to claim 3, wherein the striplines are disposed in a hollow cavity formed from two housing halves, and the housing halves in each case form an earth conductor.

19. The high-load coupler according to claim 2, wherein, the first stripline is connected to the second stripline by non-conductive fixing elements, and the fixing elements determine the position of the two striplines relative to one another in the region of the coupling portions.

20. The high-load coupler according to claim 3, wherein, the first stripline is connected to the second stripline by non-conductive fixing elements, and the fixing elements determine the position of the two striplines relative to one another in the region of the coupling portions.

* * * * *